US011754231B1

(12) United States Patent
Xu et al.

(10) Patent No.: US 11,754,231 B1
(45) Date of Patent: Sep. 12, 2023

(54) ADAPTER AND LED LAMP USING THE ADAPTER

(71) Applicant: SHENZHEN SNC OPTO ELECTRONIC CO., LTD, Shenzhen (CN)

(72) Inventors: Jianyong Xu, Shenzhen (CN); Anle Zhao, Shenzhen (CN); Zhiyuan Li, Shenzhen (CN)

(73) Assignee: SHENZHEN SNC OPTO ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 18/098,713

(22) Filed: Jan. 19, 2023

(30) Foreign Application Priority Data

Oct. 21, 2022 (CN) ..... 202222777406.3

(51) Int. Cl.

| | |
|---|---|
| ***F21K 9/235*** | (2016.01) |
| ***F21K 9/238*** | (2016.01) |
| ***F21V 23/06*** | (2006.01) |
| ***F21V 23/04*** | (2006.01) |
| ***F21V 23/00*** | (2015.01) |
| *F21Y 115/10* | (2016.01) |

(52) U.S. Cl.
CPC ..... *F21K 9/238* (2016.08); *F21V 23/005* (2013.01); *F21V 23/0442* (2013.01); *F21V 23/06* (2013.01); *F21Y 2115/10* (2016.08)

(58) Field of Classification Search
CPC ..... F21K 9/235; F21V 23/06; H01R 24/542; F21Y 2115/10
See application file for complete search history.

(56) References Cited

U.S. PATENT DOCUMENTS

| | | | | |
|---|---|---|---|---|
| 2004/0066142 | A1* | 4/2004 | Stimac | F21K 9/238 315/56 |
| 2012/0238146 | A1* | 9/2012 | Liao | H01R 31/06 439/660 |
| 2014/0273644 | A1* | 9/2014 | Mcsweyn | H01R 31/06 439/628 |
| 2014/0286020 | A1* | 9/2014 | Tsai | F21K 9/232 362/363 |
| 2016/0209017 | A1* | 7/2016 | Feller | F21S 8/00 |
| 2021/0388952 | A1* | 12/2021 | Wan | F21K 9/66 |

* cited by examiner

*Primary Examiner* — Evan P Dzierzynski

(57) ABSTRACT

The present disclosure provides an adapter and an LED lamp using the adapter, the adapter including a first body with an upper portion and a lower portion, a first electrical connection member electrically connected with the LED lamp and including at least one conductive post, a second electrical connection member with an end electrically connecting with the first electrical connection member, the other end thereof connected with an external electronic control member, and including a first protrusion with a plurality of installing holes fixing with a plurality of conductive splints therein, the external electronic control member including a third electrical connection member with a plurality of terminals therein, the lower portion including a first wall with a first recess for inserting the first protrusion therein, the plurality of terminals rotated to insert into the plurality of conductive splints for electrically connect the adapter with the external electronic control member.

19 Claims, 10 Drawing Sheets

ADAPTER AND LED LAMP USING THE ADAPTER

BACKGROUND

1. Technical Field

The present disclosure generally relates to the field of lighting technologies, and especially relates to an adapter and an LED lamp using the adapter.

2. Description of Related Art

LED lamps have advantages of energy saving, a long life and being easy control, etc, which are in line with a global advocacy of energy conservation and emission reduction, and have been widely used in various lighting fields. In order to obtain better energy saving or a control effect, some conventional LED lamps are equipped with sensors, wireless controllers or other electronic control components that are configured to control the LED lamps. However, the conventional LED lamp can be only connected with the electronic control component with a single specification thereof, and dimensions and specifications of most lamp bodies or electronic control components produced by different countries or manufacturers are different, which makes a plurality of LED lamps unable to be simultaneously applied for other electronic control components with other specifications, resulting in greatly reducing a flexible usage of the LED lamp in other countries or regions, which is not conducive to a promotion and application of such LED lamp in the world. In this way, only different specifications of bodies of the LED lamps are needed to be produced to match different specifications of the electronic control components from different countries or manufacturers, which will lead to a significant increase in production costs.

SUMMARY

The technical problems to be solved: in view of the shortcomings of the related art, the present disclosure relates to an adapter and an LED lamp using the adapter which can connect with different external electronic control members by the adapter.

an adapter according to a first aspect of an embodiment of the present disclosure includes: a first body including an upper portion detachably connected with an LED lamp, and a lower portion opposite to the upper portion and configured to detachably connect with an external electronic control member; a first electrical connection member fixedly installed on the upper portion and configured to electrically connect with the LED lamp; a second electrical connection member fixedly installed in the lower portion, one end of the second electrical connection member electrically connected with the first electrical connection member, and the other end of the second electrical connection member electrically connected with the external electronic control member; and wherein the first electrical connection member includes at least one conductive post, and the second electrical connection member includes a first protrusion with a plurality of installing holes thereof to receive a plurality of conductive splints in the plurality of installing holes; and wherein the external electronic control member includes a third electrical connection member that includes a plurality of terminals therein, the lower portion including a first wall with a first recess being formed thereof, the first protrusion inserted into the first recess and the terminal rotated to be inserted into the conductive splint, to electrically connect the external electronic control member with the second electrical connection member.

An LED lamp according to a second aspect of an embodiment of the present disclosure includes: a housing, an external electronic control member, and an adapter with one end being detachably connected with the housing and the other end being detachably connected with the external electronic control member; the adapter including a first body, a first electrical connection member and a second electrical connection member, the body including an upper portion detachably connected with the LED lamp, and a lower portion opposite to the upper portion and configured to detachably connect with the external electronic control member; the first electrical connection member fixedly installed in the upper portion and configured to electrically connect with the LED lamp, the second electrical connection member fixedly installed in the lower portion, one end of the second electrical connection member electrically connected with the first electrical connection member, and the other end of the second electrical connection member electrically connected with the external electronic control member; and wherein the first electrical connection member includes at least one conductive post, and the lower portion includes a first protrusion with a plurality of installing holes thereof to receive a plurality of conductive splints in the plurality of installing holes; and wherein the external electronic control member includes a third electrical connection member that includes a plurality of terminals therein, and a first installation member including a first wall with a first recess being formed thereof, the first protrusion inserted into the first recess and the terminal rotated to be inserted into the conductive splint, to electrically connect the external electronic control member with the second electrical connection member.

The present disclosure provides the advantages as below: the present disclosure provides the adapter applied for the LED lamp, by setting the adapter of the present disclosure, the housing of the LED lamp can be connected with external electronic control members of different specifications, that is, in addition to the housing of the LED lamp itself can be connected with the external electronic control member with a specification, the housing can also be connected with another external electronic control member with another specification through the adapter, so that the LED lamp can be applied for the external electronic control members with different specifications in different countries. The external electronic control member can be an external electronic control component, such as a sensor or a wireless controller etc., externally connected to the housing, so as to control lighting, a color or a brightness of the LED lamp.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

The element labels according to the embodiment of the present disclosure shown as below:

100 LED lamp, 10 housing, 11 first case, 12 second electrical connection member, 13 second installation member, 14 second screw thread, 15 inserting portion, 16 second circuit board, 161 annular conductive ring, 20 external electronic control member, 21 first electrical connection member, 211 terminal, 212 vertical wall, 213 horizontal wall, 22 first installation member, 221 first wall, h inner wall, 222 first recess, 223 hook, 224 guiding post, 225 limiting post, 23 second case, 30 adapter, 31 first body, 311 upper portion, 312 lower portion, 313 first protrusion, g outer surface, 314 installing hole, 315 clamping recess, 316 guiding hole, 317 limiting hole, 318 second protrusion, 319 first screw thread, 32 first electrical connection member, 33 second electrical connection member, 34 first circuit board, 35 conductive splint, 36 connecting portion, 37 clamping arm, 371 first plate, 372 second plate, 373 third plate, 374 guiding plate, a conductive post, in side surface.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described exemplary embodiment of the present disclosure, all other embodiments obtained by one of ordinary skill in the related art on the premise of no creative work are within the protection scope of the present disclosure.

It should also be understood that the terms used in the specification of the present disclosure are only for the purpose of describing specific embodiments without being intended to limit the present disclosure. As used in the description of the present disclosure and the appended claims, terms of "one", "one" and "the" in a singular form are intended to include a plural form unless the context clearly indicates otherwise.

It should also be further understood that the term "and/or" used in the description of the present disclosure and the appended claims refers to any combination of one or more of associated listed items and all possible combinations, and includes these combinations.

Figure 1:
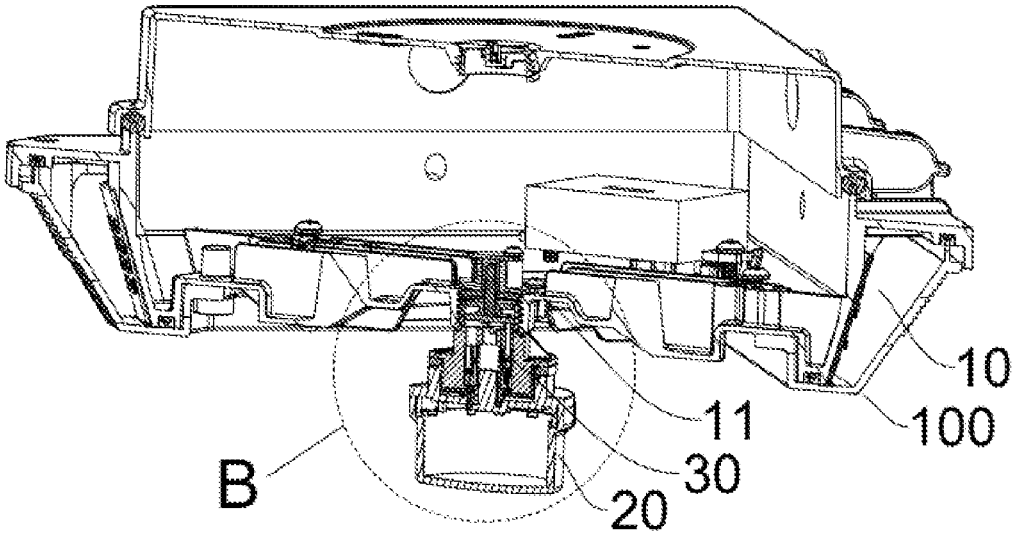
FIG. 1 is a cross sectional schematic view of an LED lamp in accordance with an embodiment of the present disclosure.
Figure 2:
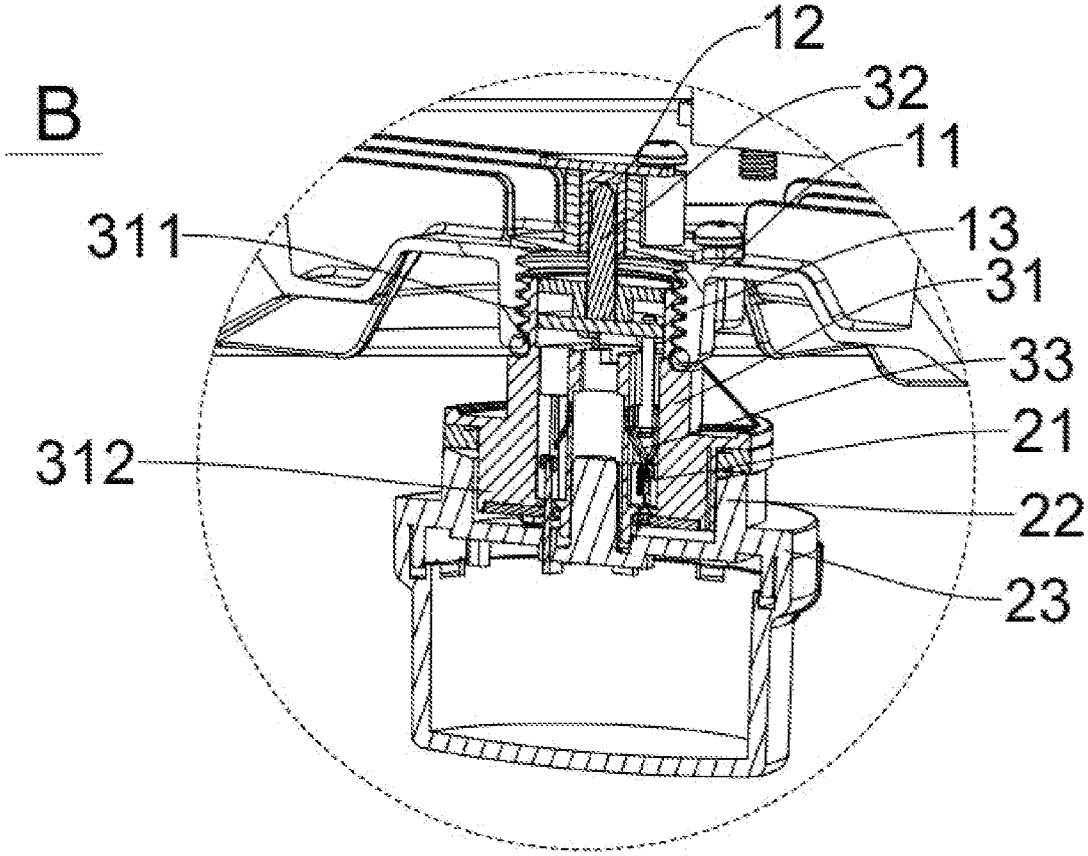
FIG. 2 is a partial enlarged view of a circle B of the LED lamp of FIG. 1.
Figure 3:
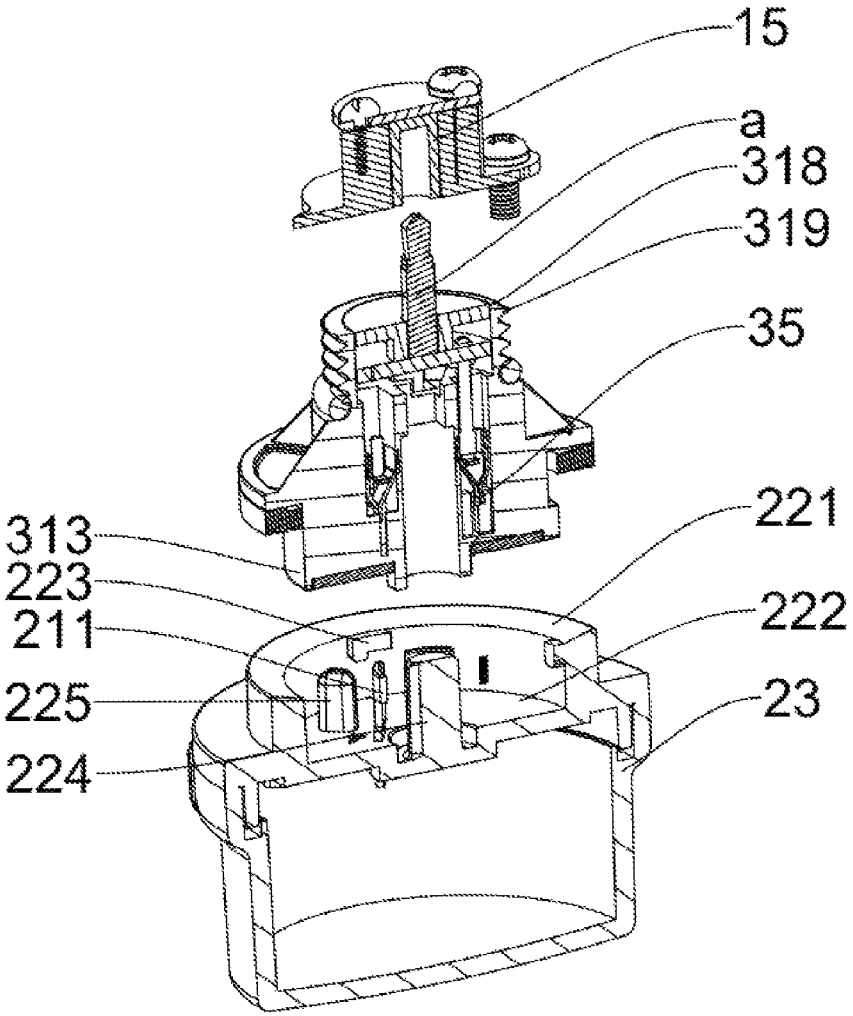
FIG. 3 is a cross sectional view of an adapter according to an embodiment of the present disclosure, which is connected with other components of the LED lamp of FIG. 1.
Figure 4:
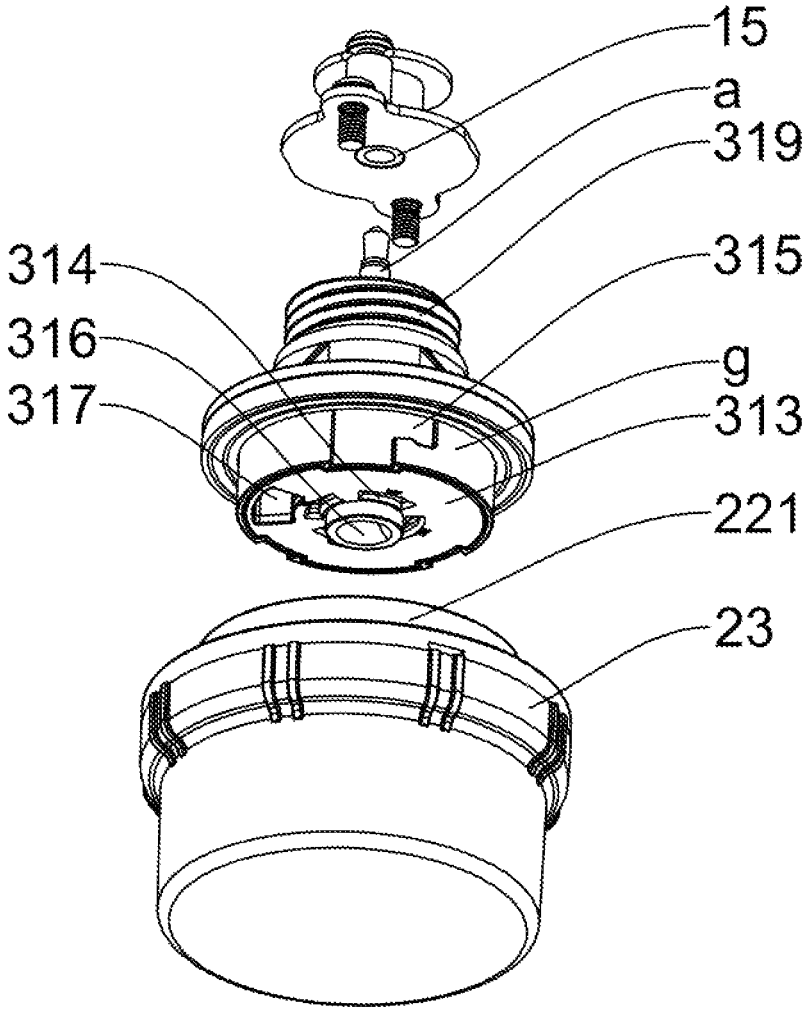
FIG. 4 is an exploded, schematic view of the adapter connected with other components of the LED lamp of FIG. 3.
Figure 5:
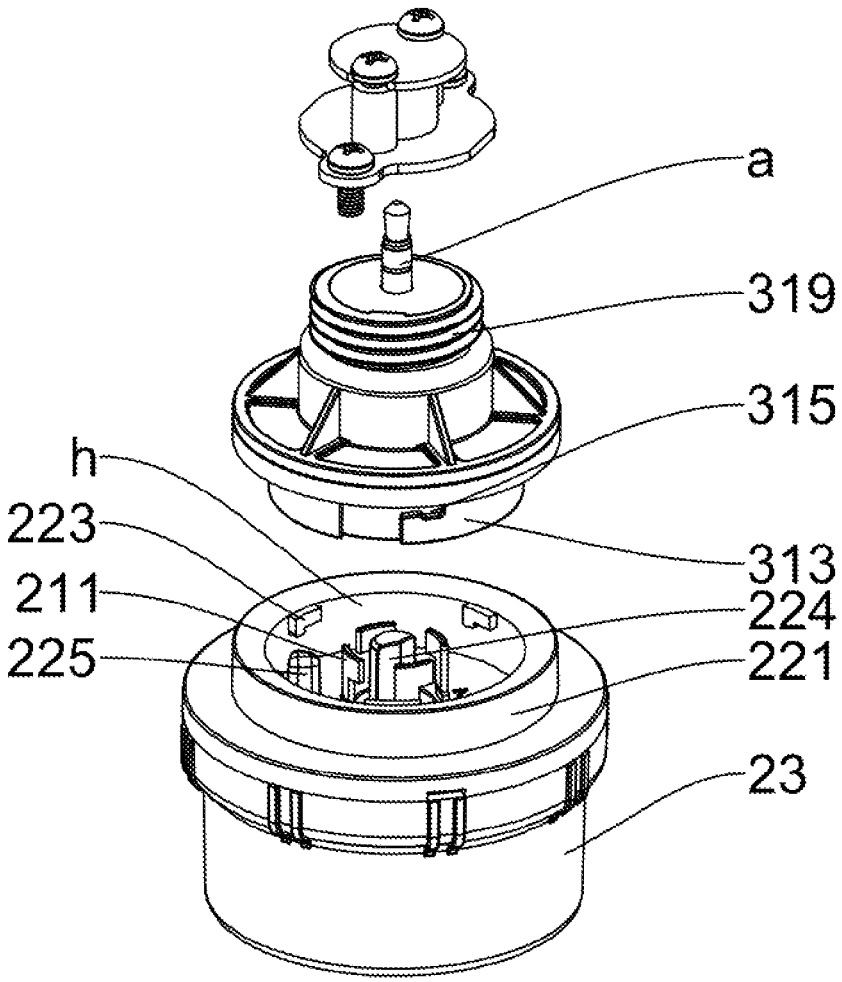
FIG. 5 is similar to FIG. 4, but shown from another view.
Figure 6:
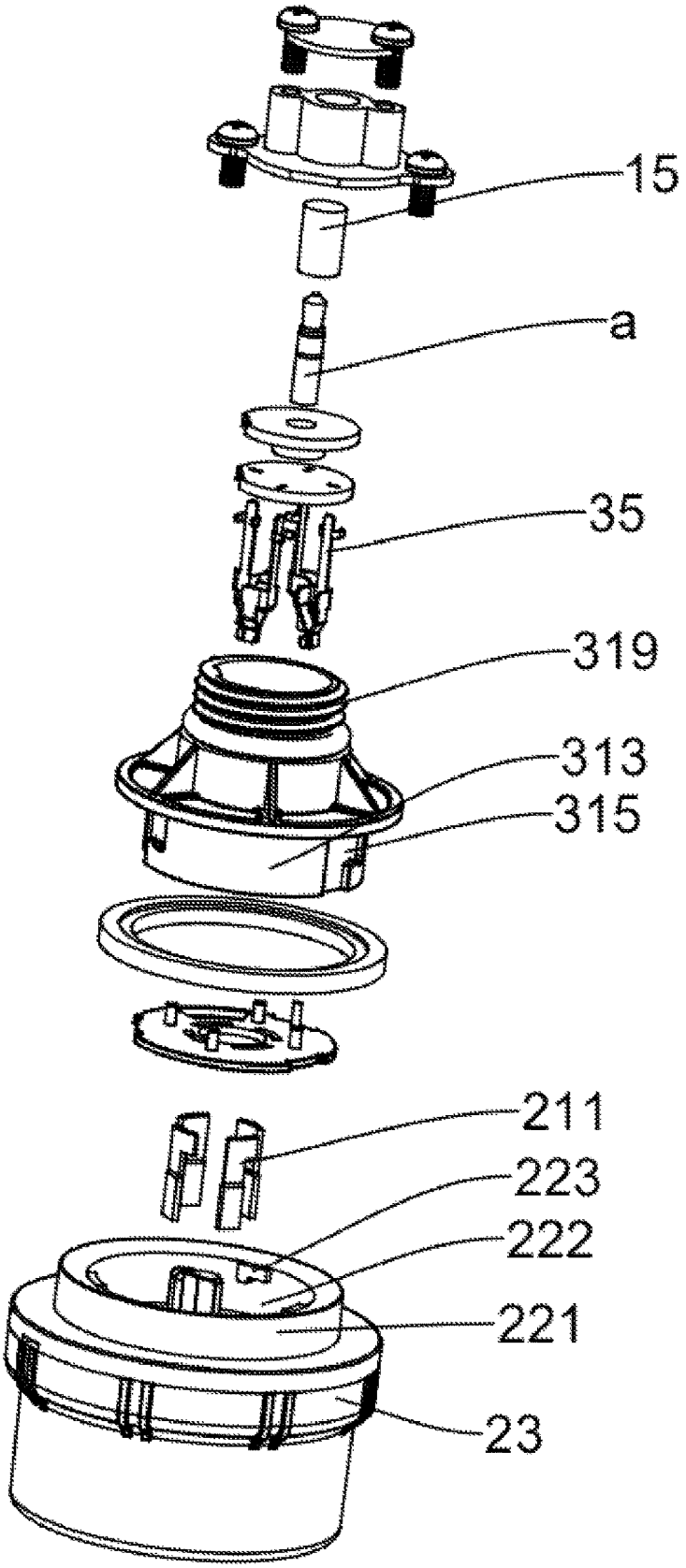
FIG. 6 is a partial exploded, schematic view of the LED lamp of FIG. 1.
Figure 7:
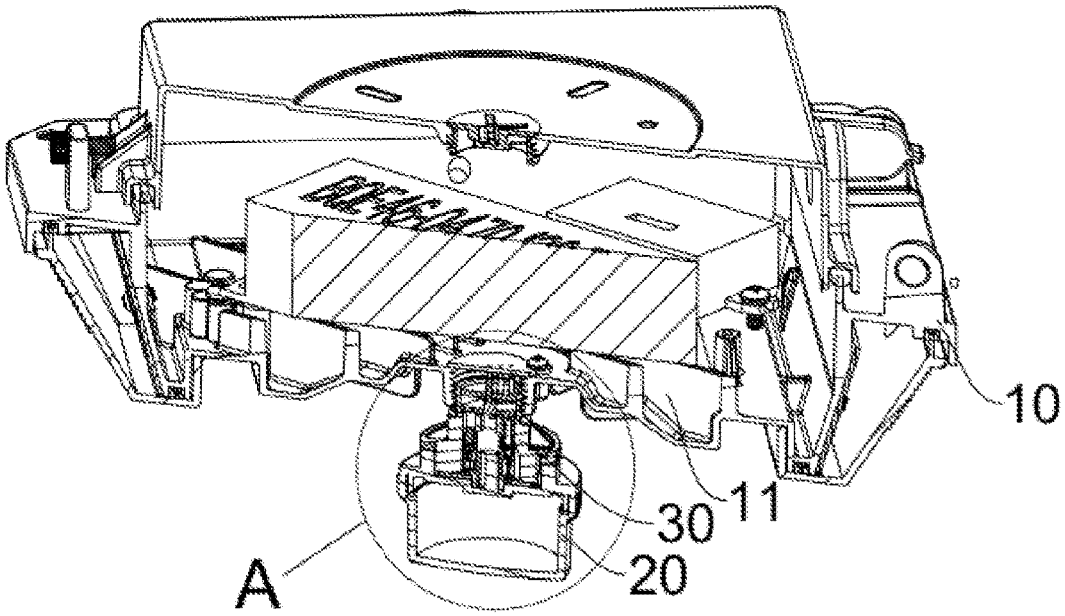
FIG. 7 is a cross sectional schematic view of an LED lamp in accordance with another embodiment of the present disclosure.
Figure 8:
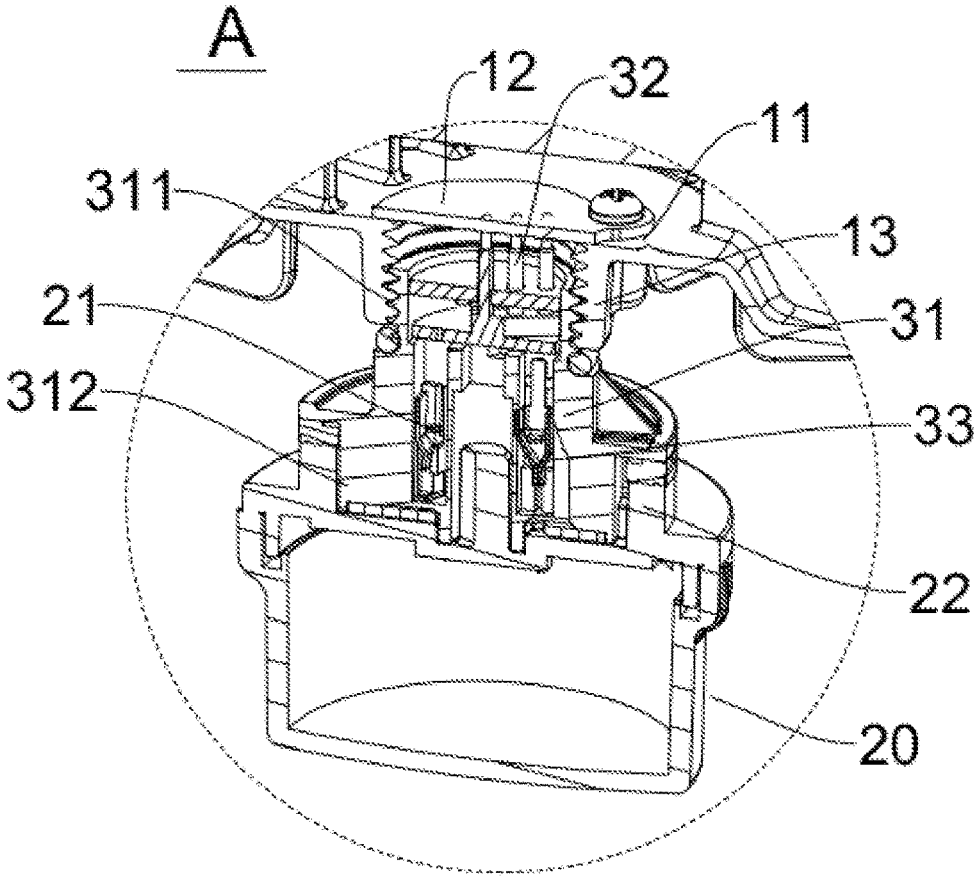
FIG. 8 is a partial enlarged view of a circle A of the LED lamp of FIG. 7.
Figure 9:
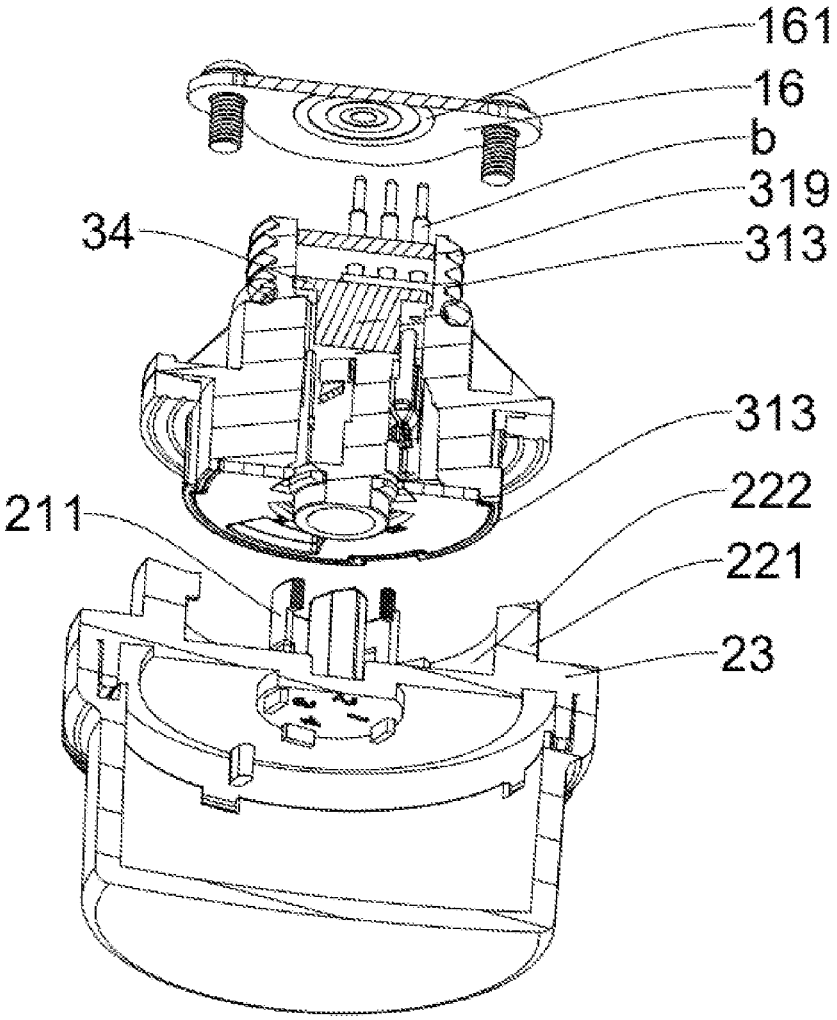
FIG. 9 is a cross sectional view of an adapter according to another embodiment of the present disclosure, which is connected with other components of the LED lamp of FIG. 7.
Figure 10:
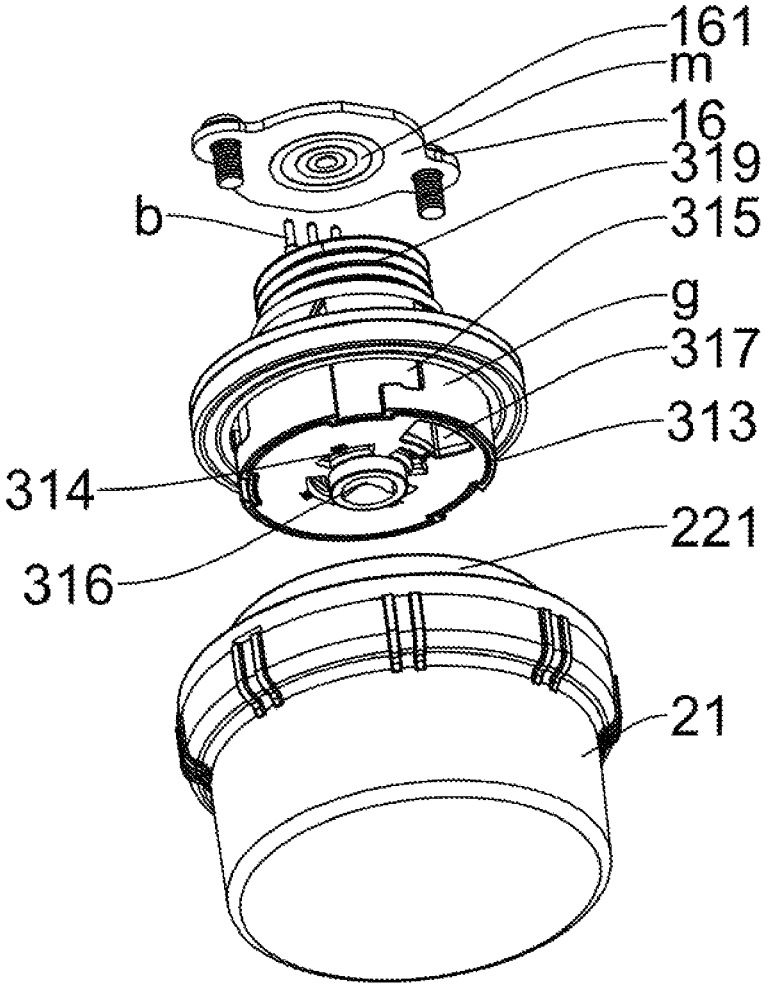
FIG. 10 is an exploded, schematic view of the adapter connected with other components of the LED lamp of FIG. 9.
Figure 11:
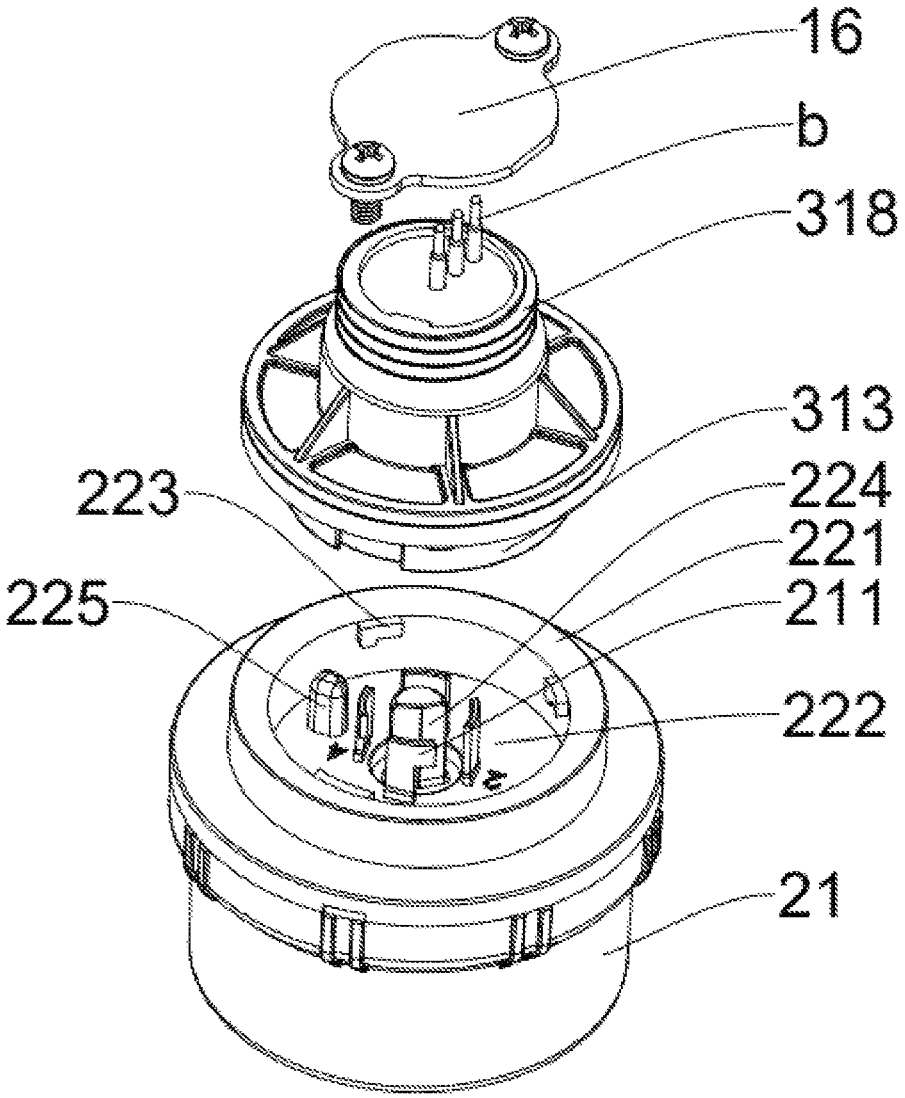
FIG. 11 is similar to FIG. 10, but shown from another view.
Figure 12:
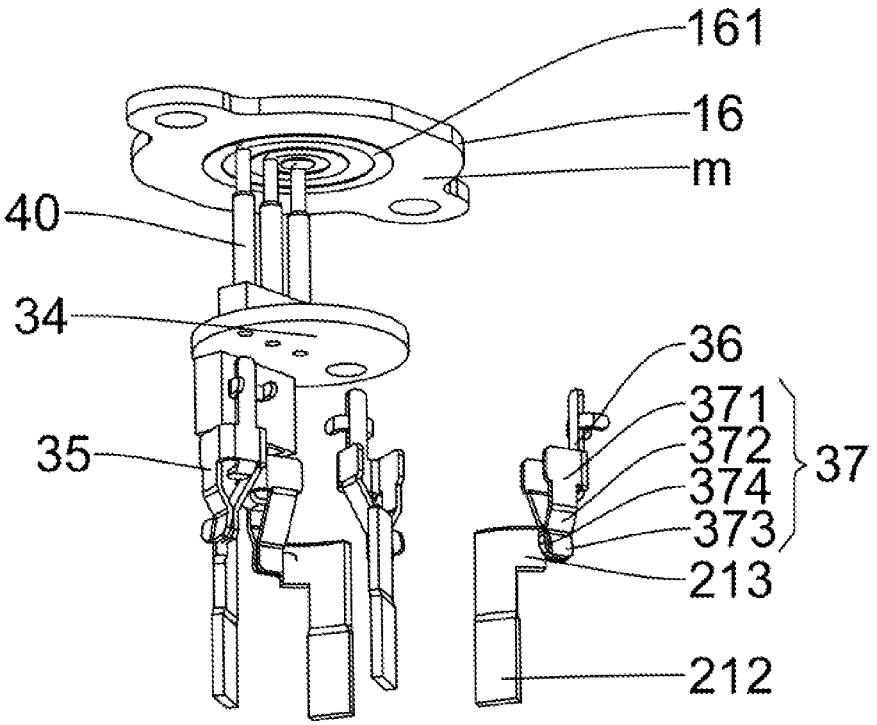
FIG. 12 is a schematic view of a conductive splint and a terminal of the LED lamp of FIG. 1.

Referring to FIGS. 1-12, an adapter 30 in accordance with an embodiment of the present disclosure is applied for an LED lamp 100 and includes a first body 31, a first electrical connection member 32 and a second electrical connection member 33. The first body 31 includes an upper portion 311 arranged close to an LED lamp 100 and detachably connected with the LED lamp 100, and a lower portion 312 opposite to the upper portion 311 and arranged close to an external electronic control member 20 and detachably connected with the external electronic control member 20.

The first electrical connection member 32 is fixedly installed on the upper portion 311 and configured to electrically connect with the LED lamp 100. One end of the second electrical connection member 33 is electrically connected with the first electrical connection member 32, and the other end of the second electrical connection member 33 is electrically connected with the external electronic control member 20.

In an embodiment of the present disclosure, the first electrical connection member 32 includes at least one conductive post a, and the second electrical connection member 33 includes a first protrusion 313 with a plurality of installing holes 314 thereof to receive a plurality of conductive splints 35 in the plurality of installing holes 314. The external electronic control member 20 includes a first wall 221 which can be an annular wall, such as a circular wall or a circular wall with an opening thereof. A first recess 222 is arranged in the first wall 221 and the first protrusion 313 is inserted into the first recess 222. The terminal 211 is inserted into the conductive splint 35 to electrically connect the external electronic control member 20 with the second electrical connection member 33. The present disclosure provides that the LED lamp 100 is electrically connected through the first electrical connection member 32 of the adapter 30, and then electrically connects the external electronic control member 20 through the second electrical connection member 33 of the adapter 30, and the first electrical connection member 32 and the second electrical connection member 33 are electrically connected with each other; thus, the LED lamp 100 can be connected with the external electronic control member 20 with the conductive terminal 211 through the adapter 30. In addition, the LED lamp 100 can also be connected to the external electronic control member 20 with a conductive-column type. In this way, the LED lamp 100 of the present disclosure can be connected with the external electronic control member 20 with a specification, and another external electronic control member 20 with another specification can be also connected through the adapter 30, so as to obtain a purpose of wider applicability of the LED lamp 100.

In an optional embodiment of the present disclosure, a guiding hole 316 is arranged at a middle position of the first protrusion 313 close to an end of the external electronic control member 20, and a guiding post 316 is arranged in the first recess 222 and inserted into the guiding hole 224. The first protrusion 313 includes a limiting hole 317 formed at an end thereof close to the external electronic control member 20, and a limiting post 225 is arranged in the first recess 222 and inserted into the limiting hole 317. A cross section of the guiding post 224 is a D-shaped configuration or a fan-shaped configuration. The limiting post 225 can prevent an excessive force from causing the guiding post 224 with a relatively small size, the guiding hole 316, the terminal 211, and the conductive splint 35 to be twisted, when the adapter 30 is rotated and docked with the LED lamp 100.

In an embodiment of the present disclosure, the terminal 211 is an L-shape configuration and includes a vertical wall 212 and a horizontal wall 213 connected with the vertical wall 212. The conductive splint 35 includes a connecting portion 36, and a pair of clamping arms 37 opposite to each other and integrally connected with the connecting portion 36, each of the pair of clamping arms 37 including a first plate 371, a second plate 372, and a third plate 373 arranged in parallel to the first plate 371, one end of the second plate 372 connected with the first plate 371 and the other end of the second plate 372 connected with the third plate 373; the third plates 373 of the pair of clamping arms 37 fitted with each other, the first plates 371 of the pair of clamping arms 37 arranged at intervals. One end of the vertical wall 212 of the terminal 211 is connected to an electronic control part of the external electronic control member 20, and the other end of the vertical wall 212 is connected to the horizontal wall 213 that is inserted between the two third plates 373, so as to electrically connect the electronic control part of the external electronic control member 20 with the conductive splint 35. In an embodiment of the present disclosure, each of the pair of clamping arms 37 further includes a guiding plate 374, one end of the guiding plate 374 connected with the third plate 373, and the other end of the guiding plate 374 extending outwardly. Two guiding plates 374 of the pair of clamping arms 37 form an outward expanding opening therebetween. When the external electronic control member 20 is installed, the horizontal wall 213 of the terminal 211 first extends into the opening, and then the external electronic control member 20 rotates to rotate the terminal 211 to further insert the horizontal wall 213 into the third plate 373, thereby good electrical contact can be ensured.

In an optical embodiment of the present disclosure, the upper portion 311 includes a second protrusion 318 with a first screw thread 319 being arranged on the periphery thereof, and the LED lamp 100 includes a second screw thread 14 arranged corresponding to the first screw thread 319, the adapter 30 detachably connected with the LED lamp 100 by the first screw thread 319 engaging with the second screw thread 14. A plurality of hooks 223 is arranged on an inner wall h of the first wall 221, and a plurality of clamping recesses 315 is arranged at positions of an outer surface g of the first protrusion 313 at the lower portion 312 corresponding to the plurality of hooks 223, so that the adapter 30 and the external electronic control member 20 can be detachably connected with each other by the plurality of hooks 223 inserting into the plurality of clamping recesses 315.

In an optical embodiment of the present disclosure, a first circuit board 34 is arranged between the first electrical connection member 32 and the second electrical connection member 33. One end of the first circuit board 34 is electrically connected with the first electrical connection member 32, and the other end of the first circuit board 34 is electrically connected with the second electrical connection member 33.

Referring to FIG. 1 to FIG. 6, in an optical embodiment of the present disclosure, the first electrical connection member 32 is a single conductive post a, the LED lamp 100 including an inserting portion 15 for inserting the conductive post a into the inserting portion 15, and the inserting portion 15 configured to electrically connect the LED lamp 100 with the first electrical connection member 32. The LED lamp 100 in the embodiment of the present disclosure can be connected to the external electronic control member 20 with a single conductive-column type, and can also be connected to the external electronic control member 20 with a conductive-terminal type through the adapter 30. In some embodiments, the conductive post a is a single earphone plug.

Referring to FIG. 7 to FIG. 12, in another optical embodiment of the present disclosure, the first electrical connection member 32 includes a plurality of elastic conductive posts b arranged side by side, the LED lamp 100 including a second circuit board 16 with a plurality of annular conductive rings 161 being arranged on the second circuit board 16 towards a side surface in of the plurality of elastic conductive posts b. The plurality of elastic conductive posts b is correspondingly abutted against the plurality of annular conductive rings 161, so that the adapter 30 is electrically connected with the LED lamp 100. The LED lamp 100 in the embodiment of the present disclosure can be connected with a plurality of external electronic control members 20 with an elastic conductive-column type formed side by side, and the external electronic control member 20 with a conductive-terminal type can also be connected through the adapter 30. In some embodiments, each of the plurality of elastic conductive posts b is an elastic thimble, and one of the plurality of elastic thimbles b is coaxial with the first wall 221.

An LED lamp 100 according to an embodiment of the present disclosure is provided and includes a housing 10, an external electronic control member 20 and an adapter 30. One end of the adapter 30 is detachably connected with the housing 10 and the other end of the adapter 30 is detachably connected with the external electronic control member 20. The adapter 30 includes a first body 31, a first electrical connection member 32 and a second electrical connection member 33. The first body 31 includes an upper portion 311 formed close to the housing 10 and detachably connect with the housing 10, and a lower portion 312 opposite to the upper portion 311 and configured to detachably connect with the external electronic control member 20. The first electrical connection member 32 is fixedly installed in the upper portion 311 and configured to electrically connect with the LED lamp 100, the second electrical connection member 33 fixedly installed in the lower portion 312, one end of the second electrical connection member 33 electrically connected with the first electrical connection member 32, and the other end of the second electrical connection member 33 electrically connected with the external electronic control member 20. Specifically, the first electrical connection member 32 and the second electrical connection member 33 can be electrically connected with each other through the first circuit board 34. That is, the first circuit board 34 is arranged between the first electrical connection member 32 and the second electrical connection member 33, one side of the first circuit board 34 electrically connected with the first electrical connection member 32, and the other side of the first circuit board 34 electrically connected with the second electrical connection member 33.

In an embodiment of the present disclosure, the first electrical connection member 32 includes at least one conductive post, and the lower portion 312 includes a first protrusion 313 with a plurality of installing holes 314 thereof to receive a plurality of conductive splints 35 in the plurality of installing holes 314. the external electronic control member 20 includes a third electrical connection member 21 that includes a plurality of terminals 211 therein, and a first installation member 22 including a first wall 221 with a first recess 222 being formed thereof, the first protrusion 313 inserted into the first recess 222 and the terminal 211 inserted into the conductive splint 35, to electrically connect the external electronic control member 20 with the second electrical connection member 33. The LED lamp 100 of the present disclosure can be connected with the external electronic control member 20 of a specification, and then can be connected with another external electronic control member 20 of another specification through the adapter 30, so as to obtain the purpose of wider applicability of the LED lamp 100.

The housing 10 includes a first case 11, both a fourth electrical connection member 12 and a second installation member 13 formed at a side of the first case 11 towards the adapter 30, the fourth electrical connection member 12 electrically connected with the first electrical connection member 32, and the second installation member 13 detachably connected with the upper portion 311 of the adapter 30.

The external electronic control member 20 includes a second case 23, and the first wall 221 is arranged on the second case 23. The terminal 211 is arranged in the first recess 222. When installing the adapter 30, the first protrusion 313 of the adapter 30 is inserted into the first recess 222. A plurality of hooks 223 is arranged on an inner wall h of the first wall 221, a plurality of clamping recesses 315 arranged on an outer surface g of the first protrusion 313 and corresponding to the plurality of hooks 223, the plurality of hooks 223 clamped into the plurality of clamping recesses 315 to detachably connect the adapter 30 with the external electronic control member 20.

In an optical embodiment of the present disclosure, a guiding hole 316 is arranged at a middle position of the first protrusion 313 close to an end of the external electronic control member 20, and a guiding post 316 is arranged in the first recess 222 and inserted into the guiding hole 224. The first protrusion 313 includes a limiting hole 317 formed at an end thereof close to the external electronic control member 20, and a limiting post 225 is arranged in the first recess 222 and inserted into the limiting hole 317. A cross section of the guiding post 224 is a D-shaped configuration or a fan-shaped configuration. The limiting post 225 can prevent an excessive force from causing the guiding post 224 with a relatively small size, the guiding hole 316, the terminal 211, and the conductive splint 35 to be twisted, when the adapter 30 is rotated and docked with the LED lamp 100.

In an embodiment of the present disclosure, the terminal 211 is an L-shape configuration and includes a vertical wall 212 and a horizontal wall 213 connected with the vertical wall 212. The conductive splint 35 includes a connecting portion 36, and a pair of clamping arms 37 opposite to each other and integrally connected with the connecting portion 36, each of the pair of clamping arms 37 including a first plate 371, a second plate 372, and a third plate 373 arranged in parallel to the first plate 371, one end of the second plate 372 connected with the first plate 371 and the other end of the second plate 372 connected with the third plate 373; the third plates 373 of the pair of clamping arms 37 fitted with each other, the first plates 371 of the pair of clamping arms 37 arranged at intervals. One end of the vertical wall 212 of the terminal 211 is connected to an electronic control part of the external electronic control member 20, and the other end of the vertical wall 212 is connected to the horizontal wall 213 that is inserted between the two third plates 373, so as to electrically connect the electronic control part of the external electronic control member 20 with the conductive splint 35. In an embodiment of the present disclosure, each of the pair of clamping arms 37 further includes a guiding plate 374, one end of the guiding plate 374 connected with the third plate 373, and the other end of the guiding plate 374 extending outwardly. Two guiding plates 374 of the pair of clamping arms 37 form an outward expanding opening therebetween. When the external electronic control member 20 is installed, the horizontal wall 213 of the terminal 211 first extends into the opening, and then the external electronic control member 20 rotates to rotate the terminal 211 to further insert the horizontal wall 213 into the third plate 373, thereby good electrical contact can be ensured.

In an optical embodiment of the present disclosure, the upper portion 311 includes a second protrusion 318 with a first screw thread 319 being arranged on the periphery thereof, and the LED lamp 100 includes a second screw thread 14 arranged corresponding to the first screw thread 319, the adapter 30 detachably connected with the LED lamp 100 by the first screw thread 319 engaging with the second screw thread 14.

Referring to FIG. 1 to FIG. 6, in an optical embodiment of the present disclosure, the first electrical connection member 32 is a single conductive post a, the LED lamp 100 including an inserting portion 15 for inserting the conductive post a into the inserting portion 15, and the inserting portion 15 configured to electrically connect the LED lamp 100 with the first electrical connection member 32. The LED lamp 100 in the embodiment of the present disclosure can be connected to the external electronic control member 20 with a single conductive-column type, and can also be connected to the external electronic control member 20 with a conductive-terminal type through the adapter 30.

Referring to FIG. 7 to FIG. 12, in another optical embodiment of the present disclosure, the first electrical connection member 32 includes a plurality of elastic conductive posts b arranged side by side, the LED lamp 100 including a second circuit board 16 with a plurality of annular conductive rings 161 being arranged on the second circuit board 16 towards a side surface in of the plurality of elastic conductive posts b. The plurality of elastic conductive posts b is correspondingly abutted against the plurality of annular conductive rings 161, so that the adapter 30 is electrically connected with the LED lamp 100. The LED lamp 100 in the embodiment of the present disclosure can be connected with a plurality of external electronic control members 20 with an elastic conductive-column type formed side by side, and the external electronic control member 20 with a conductive-terminal type can also be connected through the adapter 30. In some embodiments, the first electrical connection member 32 is composed of three elastic thimbles formed in parallel.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. An adapter comprising:

a first body comprising an upper portion detachably connected with an LED lamp, and a lower portion opposite to the upper portion and configured to detachably connect with an external electronic control member;

a first electrical connection member fixedly installed on the upper portion and configured to electrically connect with the LED lamp;

a second electrical connection member fixedly installed in the lower portion, one end of the second electrical connection member electrically connected with the first electrical connection member, and the other end of the second electrical connection member electrically connected with the external electronic control member; and wherein the first electrical connection member comprises at least one conductive post, and the second electrical connection member comprises a first protrusion with a plurality of installing holes thereof to receive a plurality of conductive splints in the plurality of installing holes; and wherein the external electronic control member comprises a third electrical connection member that comprises a plurality of terminals therein, the lower portion comprising a first wall with a first recess being formed thereof, the first protrusion inserted into the first recess and the terminal rotated to be inserted into the conductive splint, to electrically connect the external electronic control member with the second electrical connection member.

2. The adapter as claimed in claim 1, wherein a guiding hole is arranged at a middle position of the first protrusion near an end of the external electronic control member, and a guiding post is formed in the first recess and inserted into the guiding hole.

3. The adapter as claimed in claim 1, wherein each of the plurality of terminals is an L-shape configuration and comprises a vertical wall and a horizontal wall connected with the vertical wall, the conductive splint comprising a connecting portion, and a pair of clamping arms opposite to each other and integrally connected with the connecting portion, each of the pair of clamping arms comprising a first plate, a second plate, and a third plate arranged in parallel to the first plate, both ends of the second plate connected with the first plate and the third plate, respectively, the third plates of the pair of clamping arms fitted with each other, the first plates of the pair of clamping arms arranged at intervals, and the horizontal wall inserted between the third plates of the pair of clamping arms.

4. The adapter as claimed in claim 1, wherein the first protrusion comprises a limiting hole formed at an end thereof close to the external electronic control member, and a limiting post formed in the first recess and inserted into the limiting hole.

5. The adapter as claimed in claim 1, wherein the first electrical connection member is a single conductive post, the LED lamp comprising an inserting portion for inserting the conductive post therein, and the inserting portion configured to electrically connect the LED lamp with the single conductive post.

6. The adapter as claimed in claim 5, wherein the conductive post is a single earphone plug.

7. The adapter as claimed in claim 1, wherein the first electrical connection member comprises a plurality of elastic conductive posts arranged side by side, the LED lamp comprising a second circuit board with a plurality of annular conductive rings being arranged on a side surface of the second circuit board towards the plurality of elastic conductive posts, and the plurality of elastic conductive posts correspondingly abutted against the plurality of annular conductive rings.

8. The adapter as claimed in claim 7, wherein each of the plurality of elastic conductive posts is an elastic thimble, and one of the plurality of elastic thimbles is coaxial with the first wall.

9. The adapter as claimed in claim 1, wherein the upper portion comprises a second protrusion with a first screw thread being arranged on the periphery thereof, the LED lamp comprising a second screw thread arranged corresponding to the first screw thread, the adapter detachably connected with the LED lamp by the first screw thread engaging with the second screw thread.

10. An LED lamp comprising:

a housing;

an external electronic control member;

an adapter with one end being detachably connected with the housing and the other end being detachably connected with the external electronic control member; the adapter comprising a first body, a first electrical connection member and a second electrical connection member, the body comprising an upper portion detachably connected with the housing, and a lower portion opposite to the upper portion and configured to detachably connect with the external electronic control member; the first electrical connection member fixedly installed in the upper portion and configured to electrically connect with the housing, the second electrical connection member fixedly installed in the lower portion, one end of the second electrical connection member electrically connected with the first electrical connection member, and the other end of the second electrical connection member electrically connected with the external electronic control member; and wherein the first electrical connection member comprises at least one conductive post, and the lower portion comprises a first protrusion with a plurality of installing holes thereof to receive a plurality of conductive splints in the plurality of installing holes; and wherein the external electronic control member comprises a third electrical connection member that comprises a plurality of terminals therein, and a first installation member comprising a first wall with a first recess being formed thereof, the first protrusion inserted into the first recess and the terminal rotated to be inserted into the conductive splint, to electrically connect the external electronic control member with the second electrical connection member.

11. The LED lamp as claimed in claim 10, wherein the housing comprises a first case, both a fourth electrical connection member and a second installation member formed at a side of the first case towards the adapter, the fourth electrical connection member electrically connected with the first electrical connection member, and the second installation member detachably connected with the upper portion.

12. The LED lamp as claimed in claim 11, wherein the external electronic control member comprises a second case, and the first wall is arranged on the second case.

13. The LED lamp as claimed in claim 12, wherein a plurality of hooks is arranged on an inner wall of the first wall, a plurality of clamping recesses arranged on an outer surface of the first protrusion, the plurality of hooks correspondingly clamped into the plurality of clamping recesses to detachably connect the first wall with the first protrusion.

14. The LED lamp as claimed in claim 13, wherein the first electrical connection member is a single conductive post, the housing comprising an inserting portion for inserting the conductive post therein, and the inserting portion configured to electrically connect the LED lamp with the single conductive post.

15. The LED lamp as claimed in claim 13, wherein the terminal is an L-shape configuration and comprises a vertical wall and a horizontal wall connected with the vertical wall, the conductive splint comprising a connecting portion, and a pair of clamping arms opposite to each other and integrally connected with the connecting portion, each of the pair of clamping arms comprising a first plate, a second plate and a third plate arranged in parallel to the first plate, both ends of the second plate connected with the first plate and the third plate, respectively, the third plates of the pair of clamping arms fitted with each other, the first plates of the pair of clamping arms arranged at intervals, and the horizontal wall inserted between the third plates of the pair of clamping arms.

16. The LED lamp as claimed in claim 13, wherein the first electrical connection member comprises a plurality of elastic conductive posts arranged side by side, the housing comprising a second circuit board with a plurality of annular conductive rings being arranged on a side of the second circuit board towards the plurality of elastic conductive posts, and the plurality of elastic conductive posts correspondingly abutted against the plurality of annular conductive rings.

17. The LED lamp as claimed in claim 10, wherein a guiding hole is arranged at an end of the first protrusion close to the external electronic control member, and a guiding post is arranged in the first recess and inserted into the guiding hole.

18. The LED lamp as claimed in claim 10, wherein the first protrusion comprises a limiting hole formed at an end thereof close to the external electronic control member, and a limiting post is arranged in the first recess and inserted into the limiting hole.

19. The LED lamp as claimed in claim 10, wherein the external electronic control member is selected from one of a sensor and a wireless controller.

* * * * *